US012442286B1

(12) United States Patent
Xu et al.

(10) Patent No.: US 12,442,286 B1
(45) Date of Patent: Oct. 14, 2025

(54) NONLINEAR MODEL PREDICTIVE CONTROL FOR DIRECTIONAL DRILLING APPLICATIONS

(71) Applicants: Halliburton Energy Services, Inc., Houston, TX (US); Board of Regents, The University of Texas System, Austin, TX (US)

(72) Inventors: Jiamin Xu, Houston, TX (US); He Zhang, Singapore (SG); Kaixiao Tian, Singapore (SG); Nazli Demirer, Tomball, TX (US); Yang Liu, Singapore (SG); Ketan C. Bhaidasna, Houston, TX (US); Robert P. Darbe, Tomball, TX (US); Dongmei Chen, Austin, TX (US)

(73) Assignees: HALLIBURTON ENERGY SERVICES, INC., Houston, TX (US); BOARD OF REGENTS, THE UNIVERSITY OF TEXAS SYSTEM, Austin, TX (US)

( * ) Notice: Subject to any disclaimer, the term of this patent is extended or adjusted under 35 U.S.C. 154(b) by 0 days.

(21) Appl. No.: 18/747,079

(22) Filed: Jun. 18, 2024

Related U.S. Application Data

(60) Provisional application No. 63/632,116, filed on Apr. 10, 2024.

(51) Int. Cl.

| | |
|---|---|
| ***E21B 44/00*** | (2006.01) |
| ***E21B 7/10*** | (2006.01) |
| ***E21B 17/10*** | (2006.01) |

(52) U.S. Cl.
CPC ..... *E21B 44/00* (2013.01); *E21B 7/10* (2013.01); *E21B 17/1078* (2013.01)

(58) Field of Classification Search
CPC ..... E21B 44/00; E21B 44/04; E21B 44/06; E21B 45/00; E21B 47/02; E21B 47/022;
(Continued)

(56) References Cited

U.S. PATENT DOCUMENTS 11,174,720 B2 * 11/2021 Kazemi Miraki .... G01L 5/0042
11,939,857 B1 * 3/2024 Wang ..... E21B 47/02
(Continued)

FOREIGN PATENT DOCUMENTS

CN 113153257 A 7/2021
WO 2017209911 A1 12/2017

OTHER PUBLICATIONS

International Search Report & Written Opinion; PCT Application No. PCT/US2024/040533; mailed Dec. 24, 2024.
(Continued)

*Primary Examiner* — Yong-Suk (Philip) Ro
(74) *Attorney, Agent, or Firm* — NOVAK DRUCE CARROLL LLP

(57) ABSTRACT

In directional drilling, a nonlinear Delay Differential Equation (DDE) model may be used for its high precision in predicting how a borehole may be drilled according to a well plan. To address challenges associated with real-time control of a drill drilling wellbore, techniques of generalized feedback linearization, finite element concept, and zero-order hold discretization may be used to transform a nonlinear DDE model into discretized domain with a linear Ordinary Differential Equation (ODE) form. Following this transformation, a novel optimization framework may be used to concurrently determine optimal control inputs and solve a linear complementarity problem (LCP). The validity of both the discretized model and the optimization strategy may be verified by comparing modeled results with real-world results. Subsequent closed-loop simulations demonstrate the
(Continued)

ability of the proposed model predictive control to maintain alignment of a drill string with a planned well trajectory, even in the presence of disturbances and noise.

20 Claims, 12 Drawing Sheets

(58) Field of Classification Search
CPC ..... E21B 7/06; E21B 7/10; E21B 17/1078; G05D 3/12; G05B 15/02; G01V 3/30
See application file for complete search history.

(56) References Cited

U.S. PATENT DOCUMENTS

2012/0292110 A1 11/2012 Downton
2015/0369030 A1 12/2015 Hay et al.
2016/0341027 A1* 11/2016 Kyllingstad ..... E21B 7/06
2020/0011167 A1* 1/2020 Zhao ..... E21B 44/00
2023/0023709 A1 1/2023 Jamieson et al.
2023/0151725 A1* 5/2023 Hovda ..... E21B 47/04 166/311
2023/0203935 A1* 6/2023 Dahal ..... E21B 7/06 175/24
2024/0318535 A1* 9/2024 Demirer ..... E21B 44/00

OTHER PUBLICATIONS

English abstract of CN113153257A; retrieved from www.espacenet.com on Dec. 30, 2024.
Abstract of Van De Wouw, N. et al., "Dynamic state-feedback control of nonlinear three-dimensional directional drilling systems", IFAC-PapersOnLine; vol. 49, Issue 18, 2016, pp. 85-90.

* cited by examiner

NONLINEAR MODEL PREDICTIVE CONTROL FOR DIRECTIONAL DRILLING APPLICATIONS

CROSS-REFERENCE TO RELATED APPLICATIONS

This application claims the benefit of U.S. Provisional Application No. 63/632,116, filed Apr. 10, 2024, which is incorporated herein by reference.

JOINT RESEARCH AGREEMENT

Some of the subject matter in this application was made by or on behalf of Halliburton Energy Services, Inc. and the Board of Regents, The University of Texas System as a result of activities undertaken within the scope of a joint research agreement effective on or before the date the claimed invention was made.

BACKGROUND

Technical Field

The present disclosure is generally directed to controlling a drilling operation. More specifically, the present disclosure is directed to controlling a wellbore drilling operation or autonomous wellbore drilling apparatus.

INTRODUCTION

In some instances, a hole may be drilled into subterranean structures (e.g., strata of the Earth) such that certain materials (e.g., oil, natural gas, water, or brine) may be extracted. In other instances, holes drilled into subterranean structures may be used to sequester materials (e.g., carbon dioxide) or fracture rocks located within the Earth as part of a hydraulic fracturing process. Such holes are commonly referred to as wells, boreholes, or wellbores. Typically, modern drilling equipment can be guided to change directions such that individual wellbores may turn at different angles along a path toward a destination. No matter what purpose a well is drilled for, a drill path may be controlled for reasons that include safety, efficiency, and cost.

BRIEF DESCRIPTION OF THE DRAWINGS

In order to describe the manner in which the features and advantages of this disclosure can be obtained, a more particular description is provided with reference to specific embodiments thereof which are illustrated in the appended drawings.

DETAILED DESCRIPTION

Figure 1A:
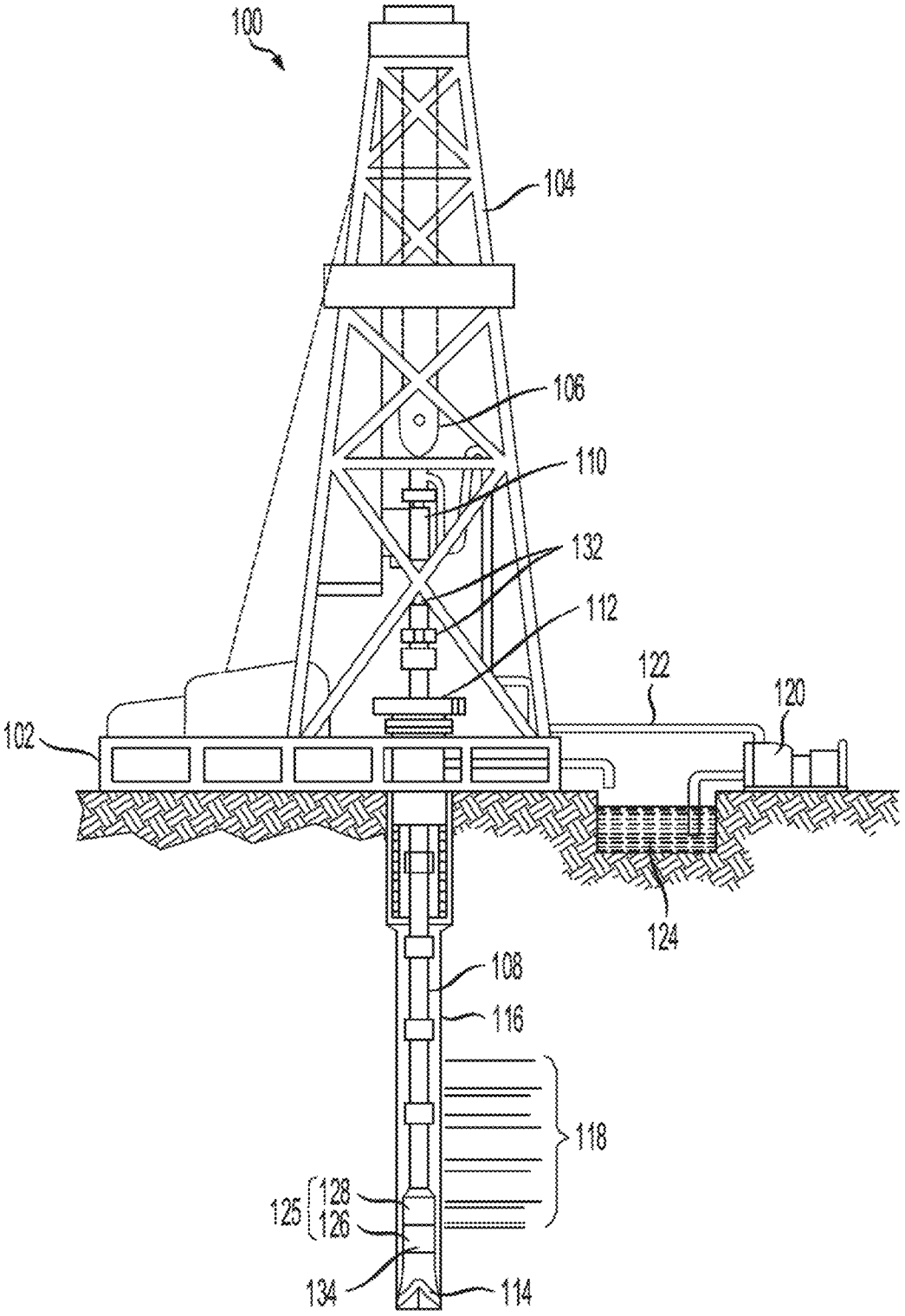
FIG. 1A is a schematic diagram of an example logging while drilling wellbore operating environment, in accordance with various aspects of the subject technology.

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous compounds. In addition, numerous specific details are set forth in order to provide a thorough understanding of the methods and apparatus described herein. However, it will be understood by those of ordinary skill in the art that the methods and apparatus described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the present disclosure.

In directional drilling, a nonlinear Delay Differential Equation (DDE) model may be used for its high precision in predicting how a borehole may be drilled according to a well plan. To address challenges associated with real-time control of a drill drilling wellbore, techniques of generalized feedback linearization, finite element concept, and zero-order hold discretization may be used to transform a nonlinear DDE model into discretized domain with a linear Ordinary Differential Equation (ODE) form. Since an ODE in the discrete domain may use finite elements associated with a bore hole assembly (BHA), this transformation may be referred to as a discrete finite element-based transformation that is associated with a BHA. Following this transformation, a novel optimization framework may be used to concurrently determine optimal control inputs and solve a linear complementarity problem (LCP). The validity of both the discretized model and the optimization strategy may be verified by comparing modeled results with real-world results. Subsequent closed-loop simulations demonstrate the ability of the proposed model predictive control (MPC) system to maintain alignment of a drill string with a planned well trajectory, even in the presence of disturbances and noise. A delayed differential equation (DDE) may be a differential equation where the derivative of a function at a certain time may be expressed in terms of values of the function at previous times.

By using a DDE model, real-time variations in densities of subterranean strata and constraints imposed by parts of a drilling apparatus may be evaluated when forecasts regarding the drilling apparatus are generated. Such forecasts may help predict, to a threshold level of precision, how best to steer the drilling apparatus. These forecasts or predictions may be used to help automatically control operation of the drilling apparatus as a borehole is drilled. As such, a DDE model may be part of an autonomous borehole directional drilling apparatus or system. The terms well, borehole, or wellbore may be used interchangeably to refer to a hole drilled into subterranean structures by a drilling apparatus.

To address challenges associated with real-time control of a wellbore drilling apparatus such as a bottom hole assembly (BHA) of a drill string, techniques of generalized feedback linearization, finite element concept, and zero-order hold discretization may be used to transform a nonlinear DDE model into the discretized domain using the form of a linear ordinary differential equation (ODE). Following this transformation, an optimization framework may be used to concurrently determine optimal control inputs and solve a linear complementarity problem (LCP). The validity of both the discretized model and the optimization strategy may be verified through comparison with results from existing literature or sets of collected data. Subsequent closed-loop simulations may be used demonstrate the ability of the proposed model predictive control (MPC) to maintain alignment of a drilling apparatus (e.g., a drill string) with a planned well trajectory, even in the presence of disturbances and noise in real-time/real-world applications.

FIG. 1A is a schematic diagram of an example logging while drilling wellbore operating environment, in accordance with various aspects of the subject technology. The drilling arrangement shown in FIG. 1A provides an example of a logging-while-drilling (commonly abbreviated as LWD) configuration in a wellbore drilling scenario 100. The LWD configuration can incorporate sensors (e.g., EM sensors, seismic sensors, gravity sensor, image sensors, etc.) that can acquire formation data, such as characteristics of the formation, components of the formation, etc. For example, the drilling arrangement shown in FIG. 1A can be used to gather formation data as part of logging the wellbore. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. Hoist 106 suspends a top drive 110 that may be suitable for rotating and lowering the drill string 108 through a well head 112. A drill bit 114 can be connected to the lower end of drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near drill bit 114. As drill bit 114 extends into the wellbore 116 through the formations 118 and as drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, or acoustic telemetry). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
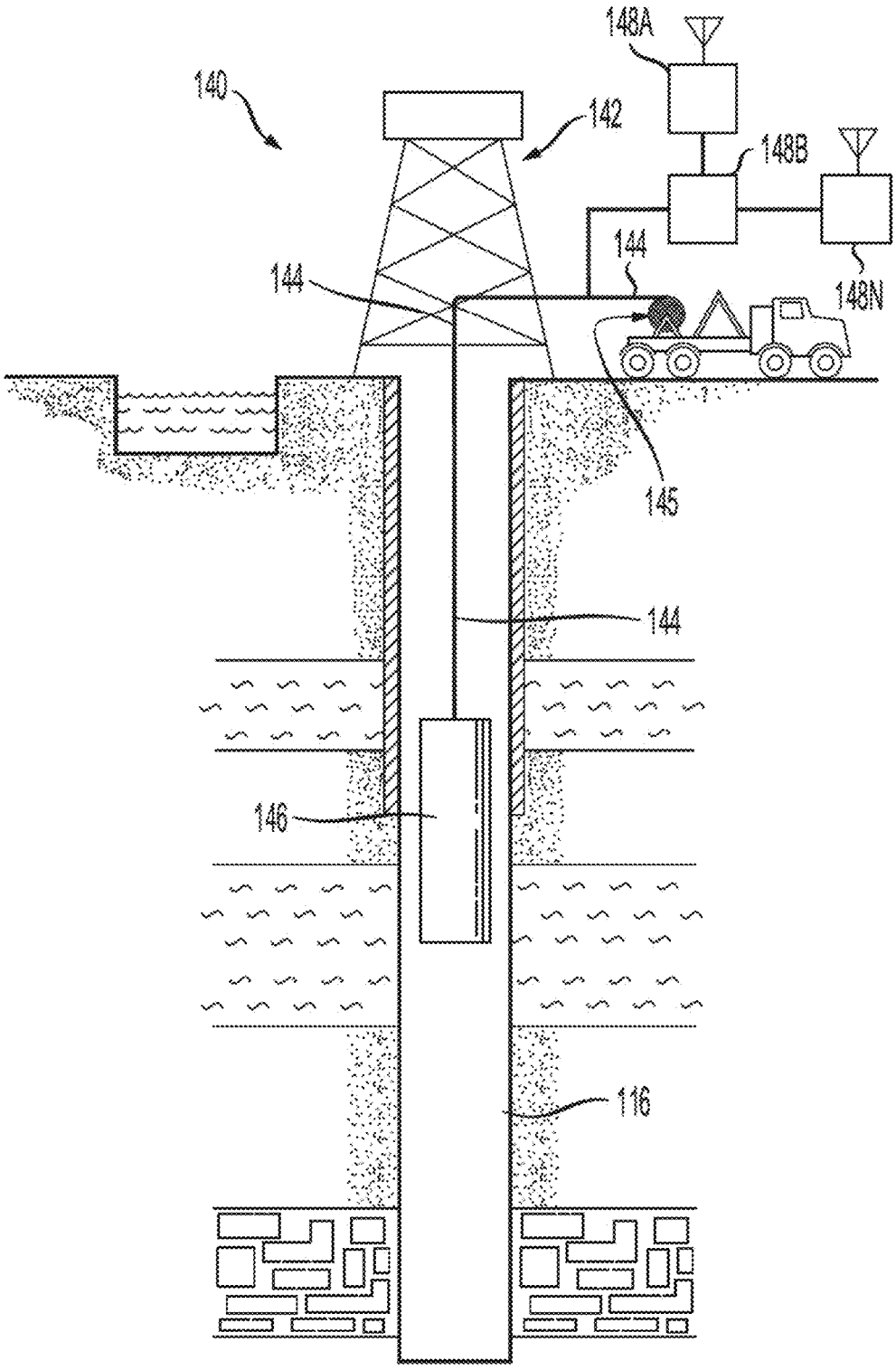
FIG. 1B is a schematic diagram of an example downhole environment having tubulars, in accordance with various aspects of the subject technology.

FIG. 1B is a schematic diagram of an example downhole environment having tubulars, in accordance with various aspects of the subject technology. In this example, an example system 140 is depicted for conducting downhole measurements after at least a portion of a wellbore has been drilled and the drill string removed from the well. An tool (not shown) can be operated in the example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario.

The illustrated wireline conveyance 144 provides power and support for the tool, as well as enabling communication between data processors 148A-N on the surface. In some examples, wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via wireline conveyance 144 to meet power requirements of the tool. For slickline or coiled tubing configurations, power can be supplied downhole with a battery or via a downhole generator.

Directional drilling revolutionizes petroleum exploration by enabling drilling not only vertically but also in curved or angled paths to access hard-to-reach hydrocarbon deposits. This technique allows drilling under urban areas or around geological obstacles, significantly enhancing oil and gas recovery efficiency and reducing environmental impact. Despite its advantages, the complexity of steering a drill bit accurately poses substantial challenges, necessitating advanced modeling and control technologies. Consequently, directional drilling continues to be a focal point of innovation in the oil and gas industry, aimed at optimizing recovery while minimizing risks.

Figure 2:
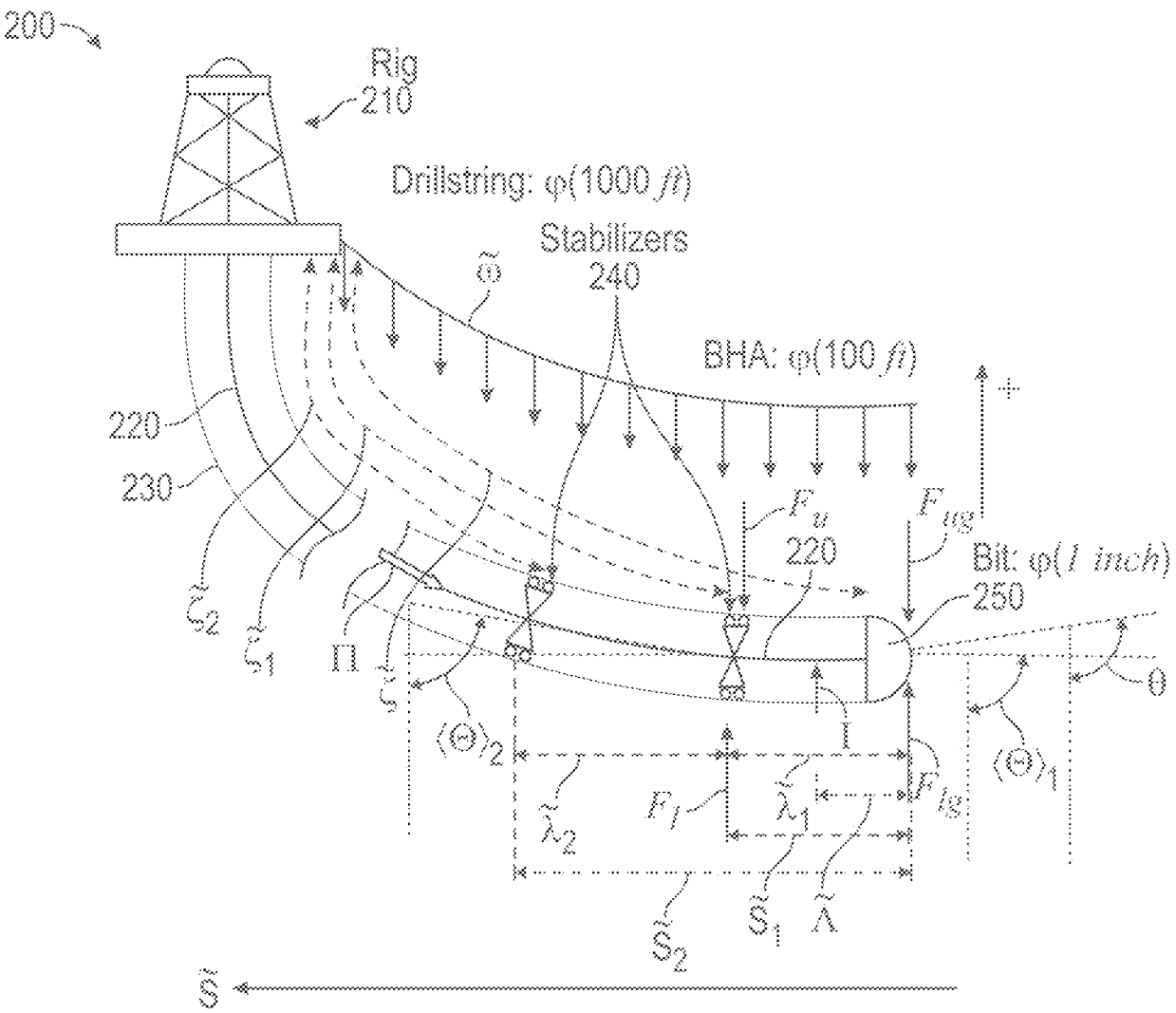
FIG. 2 illustrates a setup of a rotary steerable system (RSS) that may be used to drill a borehole in various directions, in accordance with various aspects of the subject technology.

FIG. 2 illustrates a setup of a rotary steerable system (RSS) that may be used to drill a borehole in various directions. RSS system 200 may facilitate the continuous rotation of a drill string or portion of a drilling apparatus based on autonomous control of the RSS system 200. This may result in improved hydraulic performance, may allow for more intricate boreholes to be drilled, and may result in a drill being able to operate longer than otherwise possible. System 200 includes drilling rig 210 and drill string 220 that are used to drill wellbore (borehole) 230. Note that drill string 220 extends downward from rig 210 along a curved path. Drill string 220 includes stabilizers or rings 240 located along portions of a bottom hole assembly (BHA) of the drill string. Drill bit 250 is located at the lower end (i.e., a bottom end) of drill string 220. Edges of stabilizers 240 may contact internal surfaces of wellbore 230. Stabilizers 240 may help center the BHA in the wellbore or may be used to help direct the drill bit 250. In certain instances, drill bit 250 may be coupled to the BHA with a rotary steering actuator. This rotary steering actuator may be used to help steer drill bit 250 in various directions (e.g., up, down, left, and/or right direction). Alternatively, or additionally, pads connected to drill string 220 may extend from side portions of the BHA to steer the drill bit 250 in different directions. A control system may be used to change the attitude of drill bit 250 and/or extend or retract specific steering pads of the BHA as wellbore 230 is drilled.

When pads are used to steer the drill bit, these pads may engage a wall of wellbore 230 to apply forces that push the drill bit in a desired direction (e.g., up, down, left, and/or right). When wellbore 230 is drilled, drill bit 250 may be steered as the bit is pushed into subterranean strata. In such instances, push forces may be applied along the drill string from drilling rig 210. Since this operation includes both pushing a remote drill bit and steering the drill bit, this operation is referred to herein as a push-the-bit rotary steerable system (RSS) operation. Drill string 220 may include a lengthy hollow cylinder that extends over significant distances (e.g., for thousands of feet). This drill string may be anchored to drilling rig 210 and the drill string 220 may couple both rotation and axial forces to drill bit 250. The axial forces may be referred to as the weight-on-bit (WOB).

Stabilizers or rings 240 may have a diameter that is larger than a pipe that is adjacent to the BHA. These stabilizers or rings 240 may help locate the drill string in a central position of the borehole. Although parts of the drill string may be under tension due to its weight, the BHA may be under compression when the drill bit is pressed into subterranean strata. Such compressive forces may be used to apply an axial force or an active WOB. This axial force or active WOB may be a portion of a total WOB. A total measure of WOB may be managed from a drilling rig located at the surface of the Earth. As such, the total WOB may include a portion of the weight of the drill string and may include a portion of force applied on the drill string from the surface. The portion of the total weight on a bit that forces the drill bit to cut into subterranean strata may be referred to as the active WOB. This active WOB may correspond to the force used to push specific cutting surfaces of the drill bit into the strata as the drill bit cuts into the strata.

While computer models that describe directional drilling exist, existing computer models fall short in providing a closed-form solution for real-time control applications. This is true despite the use of delay differential equations (DDEs) and the solving of a linear complementarity problem (LCP) by some computer models. Methods and apparatus of the present disclosure provide several key contributions to overcoming limitations inherent in legacy computer modeling techniques.

This process may be used to transform a nonlinear DDE model with LCP elements into a discretized domain represented by a linear ordinary differential equation (ODE) with a uniform step size. Such a uniform step size may correspond to change in wellbore depth or length along wellbore 230. As such, a step size may correspond to a number of feet along a path cut by a drilling apparatus.

Methods consistent with the present disclosure may use a generalized feedback linearization technique, a finite element concept, and zero-order hold discretization. Feedback linearization is a technique that may transform a nonlinear system into a linear controllable system. Such a technique may begin with a system described by the equation: $\dot{x}=Ax+B\gamma(x)[u-\alpha(x)]$. Here, x represents state variables; u represents a control input; A and B are constant matrices; and $\gamma(x)$ and $\alpha(x)$ are nonlinear functions. By keeping the linear term Ax and setting input u as: $u=\alpha(x)-\beta(x)Kx$, nonlinear terms $\gamma(x)$ and $\alpha(x)$ may be cancelled out and the original system my a be regularized to: $\dot{x}=(A-BK)x$. This is demonstrated by the following substitution and mathematical operations. Since:

$$\dot{x}=Ax+B\gamma(x)[u-\alpha(x)], \text{ and}$$

$$u=\alpha(x)-\beta(x)Kx, \text{ then}$$

$$\dot{x}=Ax+B\gamma(x)[(\alpha(x)-\beta(x)Kx)-\alpha(x)], \text{ therefore:}$$

$$\dot{x}=Ax+B\gamma(x)[-\beta(x)Kx]=Ax-B\gamma(x)\beta(x)Kx,$$
$$\text{when } \beta(x)=\gamma^{-1}(x), \text{ and}$$

$$\dot{x}=(A-BK)x$$

Depending on the type of system, state variables x may refer to factors such as electrical current or velocity of a vehicle and control input could be a voltage of an electrical circuit or a steering angle of a vehicle, for example. Nonlinear functions $\gamma(x)$ and $\alpha(x)$ may be functions that correspond to the type of system. Such a system may be stabilized by choosing a suitable gain K. Since the drilling application discussed herein may described by an equation other than $\dot{x}=Ax+B\gamma(x)[u-\alpha(x)]$, the mathematical operations reviewed above is an example of the feedback linearization technique.

Like the mathematical operations discussed above, a generalized feedback linearization technique may be applied to a nonlinear delayed differential equation (DDE) $x'=Ax+Mz+Ee+B_1\Gamma+B_2w$ that represents a wellbore drill steering system. This DDE may be constrained by limiting Ax to being a linear term. As such, this generalized feedback linearization technique may use the DDE $x'=Ax+Mz+Ee+B_1\Gamma+B_2w$ when keeping Ax as a linear term and when other terms are treated as time varying inputs u.

The finite element concept mentioned above may be used to represent a continuous object or field by discretizing it into smaller, manageable units that may be referred to as "elements." Instead of directly evaluating a variable like temperature at every possible location within an object, the finite element concept may approximate the variable using values at specific, strategically chosen points within these "elements." For example, rather than continuously monitoring the temperature along an entire length of a rod, the finite element concept may use a series of densely spaced and uniformly distributed points along the rod to approximate the temperature profile of the rod. This may be used to simplify complex systems into a finite number of elements. In such instances, the behavior of the system can be efficiently solved using numerical methods. This method may be used to discretize control of a BHA. When applied, these techniques may be used to eliminate the need to interpolate values at all positions of the BHA as a drill bit of the BHA drills into subterranean strata.

As such, this process may be used to transform a nonlinear DDE model with LCP elements into a discretized domain represented by a linear ordinary differential equation (ODE) with a uniform step size. Such a uniform step size may correspond to change in wellbore depth or length along a wellbore like wellbore 230 of FIG. 2. As such, a step size may correspond to a number of feet along a path cut by a drilling apparatus.

A delayed differential equation (DDE) may include constants, linear factors, and nonlinear factors associated with a borehole drilling apparatus and shapes of the borehole. Furthermore, the DDE may include factors associated steering mechanisms of an autonomous wellbore drilling apparatus. In one instance, a nonlinear DDE model that uses two stabilizers may be described by equation 1: $x'=Ax+Mz+Ee+B_1\Gamma+B_2w$. Matrices (1) below may be used to store constants and factors that are used to calculate values of x' according to equation 1.

$$\begin{cases} A=\begin{bmatrix} -\frac{\tilde{\lambda}_1+\tilde{\lambda}_2}{\chi\Pi\tilde{\lambda}^2} & \frac{\tilde{\lambda}_1}{\chi\Pi\tilde{\lambda}^2} & \frac{\tilde{\lambda}_2}{\chi\Pi\tilde{\lambda}^2} \\ 0 & 0 & 0 \\ 0 & 0 & 0 \end{bmatrix}, \\ x=[\theta \;\; \langle\Theta\rangle_1 \;\; \langle\Theta\rangle_2]^T, \\ M=\begin{bmatrix} -\frac{\tilde{s}_1(\tilde{\lambda}-\tilde{s}_1)(2\tilde{\lambda}-\tilde{s}_1)}{2\chi\Pi\tilde{\lambda}^2} & \frac{\tilde{s}_1(\tilde{\lambda}-\tilde{s}_1)(2\tilde{\lambda}-\tilde{s}_1)}{2\chi\Pi\tilde{\lambda}^2} & 0 & 0 \\ 0 & 0 & 0 & 0 \\ 0 & 0 & 0 & 0 \end{bmatrix}, \\ z=[F_l \;\; F_u \;\; F_{gl} \;\; F_{gu}]^T, \\ E=\begin{bmatrix} 0 & 0 & 0 \\ \frac{1}{\tilde{\lambda}_1} & -\frac{1}{\tilde{\lambda}_1} & 0 \\ 0 & \frac{1}{\tilde{\lambda}_2} & -\frac{1}{\tilde{\lambda}_2} \end{bmatrix}, \\ e=[\Theta \;\; \Theta(\tilde{\zeta}_1) \;\; \Theta(\tilde{\zeta}_2)]^T, \\ B_1=\begin{bmatrix} -\frac{\tilde{\Lambda}(\tilde{\lambda}-\tilde{\Lambda})(2\tilde{\lambda}-\tilde{\Lambda})}{2\chi\Pi\lambda^2} & 0 & 0 \end{bmatrix}^T, \\ B_2=\begin{bmatrix} \frac{1}{8\chi\Pi}\tilde{\omega}\tilde{\lambda} & 0 & 0 \end{bmatrix}^T \end{cases} \quad (1)$$

Here $\Theta$ may be a drill string inclination at the bit; $(\Theta)_1$ and $(\Theta)_2$ may represent the averaged borehole inclinations from the bit to the first stabilizer and from the first to the second stabilizer, respectively; $F_l\geq 0$, $F_u\geq 0$ are the lower and upper contact forces of the first stabilizer, respectively; $F_{gl}\geq 0$, $F_{gu}\geq 0$ are the lower and upper contact forces of the bit gauge, respectively; $\Theta$, $\Theta(\zeta_1)$, and $\Theta(\zeta_2)$ are the borehole inclination at the bit, first stabilizer, and second stabilizer, respectively, which introduce the delay; $\Gamma$ is the normalized pad force; gravitational effects of the BHA may be expressed as $w=\sin((\Theta)_1)$. Here, z refers to a force, e refers to borehole inclinations along the BHA, $\Gamma$ refers to normalized pad force. Furthermore, z, e, $\Gamma$, and w may be nonlinear terms, while A, M, E, $B_1$ and $B_2$ may be constant matrices, where $$\tilde{\lambda}_i=\frac{\lambda_i}{\lambda_1}$$

with $\lambda_i$ denoting the distance from the (i−1)th to the ith stabilizer, $\tilde{s}_i=\Sigma_{j=1}^{\;i}\tilde{\lambda}_j$, $\tilde{\lambda}=\Sigma_{j=1}^{\;2}\tilde{\lambda}_j$;

$$\tilde{\zeta}_i=\frac{\zeta_i}{\lambda_1}$$

with $\zeta_i$ being the distance from the bit to the ith stabilizer;

$$\tilde{\Lambda}=\frac{\Lambda}{\lambda_1}$$

with Λ being the distance between the pad and the bit. In certain instances, the forces discussed herein may be normalized by a characteristic force $$F^* = \frac{3EI}{\lambda_1^2} \cdot \tilde{\omega} = \frac{\omega\lambda_1}{F^*}$$

with ω being the distributed weight of the BHA;

$$\Gamma = \frac{F_{Pad}}{F^*}$$

with $F_{Pad}$ being the pad force that steers the BHA to the desired direction. Π may represent the active weight on bit (WOB) and may be assumed to be equivalent to the measured WOB, implying that all the weight is transferred to the rock-cutting process with no frictional loss; χ is the angular steering resistance. This angular steering resistance may be expressed as a coefficient that corresponds to how easily the BHA or a drill bit of the BHA can be rotated or bent. This steering resistance is similar to the friction coefficient of a floor used to identify how easily a box can be dragged along the floor. The higher the friction coefficient, the rougher the floor is, the more force you will need to apply to drag that box across the floor. As such, the force required to steer a BHA along a path will increase as the angular steering resistance increases.

The symbol Tis a transpose symbol used to convert a row vector to a column vector. Terms with the tilde refer to normalized or dimensionless/unitless numbers. The term $\tilde{\lambda}_i$ refers to a normalized distance that is a function of $$\frac{\lambda_i}{\lambda_1}.$$

For a BHA that has two stabilizers, $\tilde{\lambda}_i$ may correspond to values of either $\lambda_1$ or $\lambda_2$ that each have units in feet, $$\frac{\lambda_i}{\lambda_1}$$

will be a dimensionless number. Force F* may be a characteristic force used to normalize forces in these equations. The term E is a modulus of elasticity of the BHA and I may refer to the planar moment of inertia of the BHA.

Figure 3:
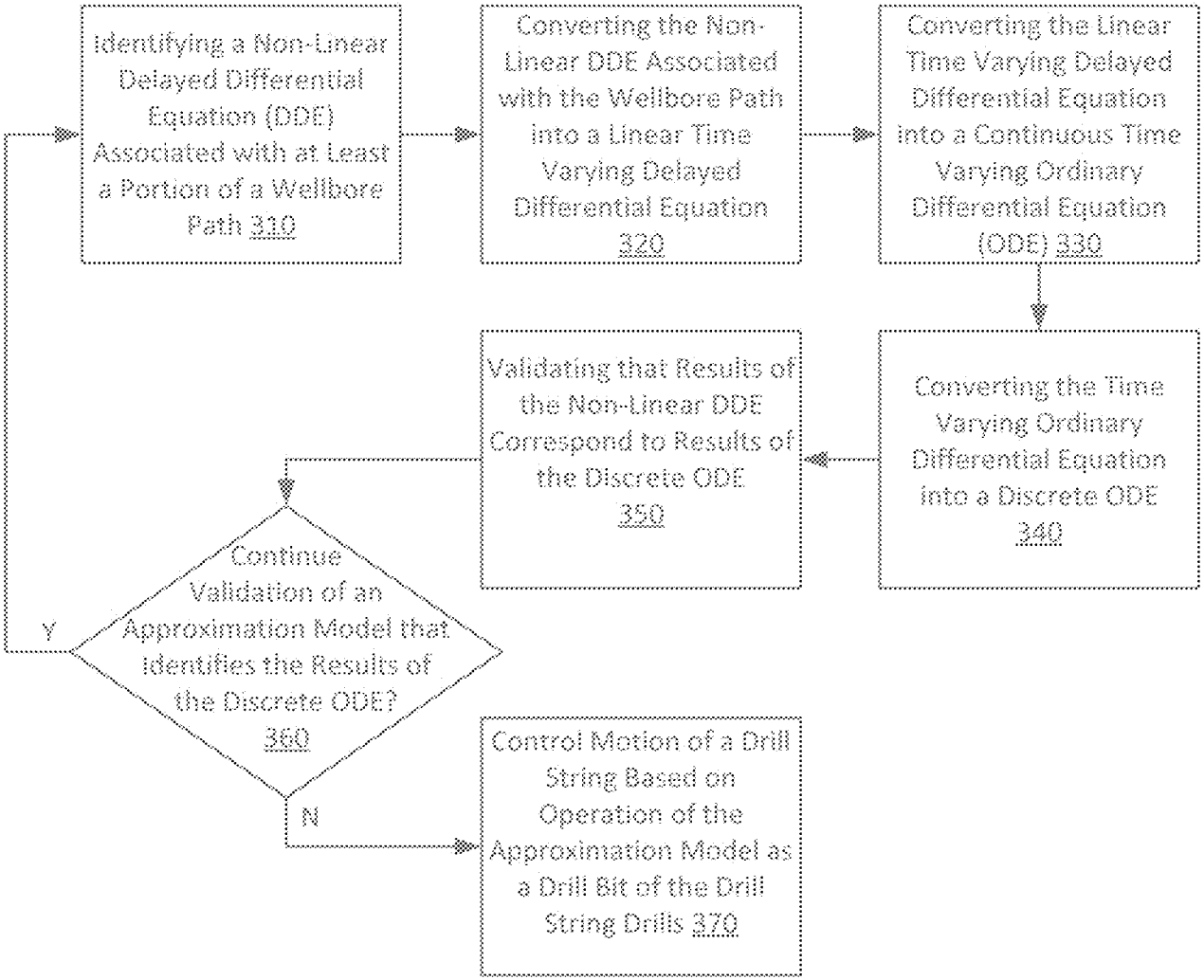
FIG. 3 illustrates actions that may be performed when a wellbore is drilled by an autonomous wellbore drilling apparatus, in accordance with various aspects of the subject technology.

FIG. 3 illustrates actions that may be taken when the direction that a drilling assembly of a borehole assembly (BHA) autonomously drills along a path. At block 310 a nonlinear DDE that describes operation of a BHA drilling assembly. For example, when the BHA includes two stabilizers, the nonlinear DDE may correspond to equation 1: $x'=Ax+Mz+Ee+B_1\Gamma+B_2w$. As discussed above, a feedback linearization technique may be employed such that the nonlinear terms may be considered as being time varying inputs u. At block 320 the nonlinear DDE may be converted into a linear time varying DDE. This means that the x' may be expressed as the linear time varying DDE in the form of formula (2) below.

$$x' = Ax + \underbrace{[M\ E\ B_1\ B_2]}_{\tilde{B}} \underbrace{\begin{bmatrix} z \\ e \\ \Gamma \\ w \end{bmatrix}}_{\tilde{u}} \tag{2}$$

At block 330, the time varying DDE may be converted into a continuous time varying ordinary differential equation (ODE). This continuous time varying ODE may be consistent with formula (4) below and this approach may eliminate the need for interpolation. This time varying ODE may be converted into a discrete ODE at block 340. It is noted that formula (2) may contain delay terms, which may be used to perform interpolation of stored history of borehole inclination Θ at any position of the BHA. While this limitation may complicate its formulation as a constraint within a borehole path optimization problem, by discretizing the BHA into $n_1+n_2$ segments, e can be rewritten as matrices (3) below. As such, the finite element concept may be used at block 340 to discretize a borehole path into manageable elements or units like those mentioned above. This may allow for control of a drilling direction of the BHA to be as a set of discrete control settings that correspond to a drill path to a threshold degree.

Matrices (3) shown below include values of E and e, where E maybe a coefficient of e. Here e may represent borehole inclinations along the wellbore instead of initial conditions. The term Ee may be a geometric influence on the direction that the bit will go under a certain force. When the borehole is totally vertical, then e=[0, 0, . . . 0]^T. This is similar to stabbing soil or sand with a knife. Even when a same force is applied, the direction along which the force is applied will be different when a bent knife is used as compared to when a straight knife is used. In the bent knife instance, e is not equal to 0 and the direction that the force is applied is not vertical. When a straight knife is used, e=[0, 0, . . . , 0]^T.

$$\begin{cases} \tilde{E} = \begin{bmatrix} 0 & 0 & \dots & 0 & 0 & 0 & \dots & 0 & 0 \\ \frac{1}{\tilde{\lambda}_1} & 0 & \dots & 0 & -\frac{1}{\tilde{\lambda}_1} & 0 & \dots & 0 & 0 \\ 0 & 0 & \dots & 0 & \frac{1}{\tilde{\lambda}_2} & 0 & \dots & 0 & -\frac{1}{\tilde{\lambda}_2} \end{bmatrix} \\ \tilde{e} = [\Theta \quad \Theta_1 \quad \dots \quad \Theta_{n_1} \quad \Theta_{n_1+1} \quad \dots \quad \Theta_{n_2}]^T \end{cases} \tag{3}$$

Here, $\Theta_{n_1}=\Theta(\zeta_1)$, $\Theta_{n_2}=\Theta(\zeta_2)$ and ẽ may be updated at each step through a linear equation or set of linear equations. As mentioned above, a step size may correspond to a change in wellbore depth or length along a wellbore. For example, a step may be associated with points separated along the wellbore by a distance of 0.1 feet.

$$x' = Ax + \underbrace{[M\ \tilde{E}\ B_1\ B_2]}_{\tilde{B}} \underbrace{\begin{bmatrix} z \\ \tilde{e} \\ \Gamma \\ w \end{bmatrix}}_{\tilde{u}} \tag{4}$$

As mentioned above, the continuous time varying ODE may be converted into a discrete ODE at block 340. The discrete ODE may be consistent with the form of formula (5)

below. This conversion or transformation may be made with a uniform step size. Furthermore, a zero-order hold technique may be used to transform the ODE from continuous domain to a discrete domain. This zero-order hold technique may assume that input values remain constant over a sampling interval. This assumption simplifies the discretization process, enhancing computational efficiency. The corresponding equation (5) below may be expressed as:

$$\begin{cases} x[k+1] = A_d x[k] + B_d u[k] \\ A_d = e^{AT},\ B_d = \left[\int_0^T e^{A\sigma} d\sigma\right] B \end{cases} \tag{5}$$

Other discretization techniques such as first order-hold, trapezoidal approximation, and higher-order polynomial approximations, exponential, sinusoidal, or green's function, may also be applied here, but they may require higher a computational burden. Techniques of the present disclosure use fewer computational resources while accounting for more variables than other methods. For example, a computer model modeling a system that corresponds to $\dot{x}=(A-BK)x$ takes about 5 minutes to compute results while evaluation a simpler control system that does not model stabilizers and bit tilt saturation. A computer model that performs a quasi-linear DDE according to the equation $\dot{x}(\zeta)=A_0x(\zeta)+\Sigma_{i=1}^{n} A_i x(\zeta-z_i)+Bu$ would also take about 5 minutes to compute results also without modeling stabilizers and bit tilt saturation. Approaches that model stabilizers and bit tilt saturation, for example, a finite element model of the form $\int_0^1 f(x)v(x)dx=\int_0^1 u''(x)v(x)dx$ requires over an hour to compute results. In contrast, techniques of the present disclosure generate results in less than 5 minutes even when modeling stabilizers and bit tilt saturation. These comparisons compare the performance of a same compute resource running each of the respective models discussed above. As such, the present technique improves the operation of a computer, a computer controlled autonomous control system, and an automated drilling system.

In order to validate methods of the present disclosure, results of simulations that model the nonlinear DDE may be compared with results of an approximation model at block 350. Here the approximation model may identify results of the discrete ODE of block 340 and a nonlinear DDE model may be used to identify results of a nonlinear DDE model. When the results of the approximation model match the results of the nonlinear DDE within a tolerance or threshold, the approximation model may be classified as being validated.

Determination block 360 may then identify whether validation of the approximation model should continue, when yes, program flow may move back to block 310 where another nonlinear DDE may be identified. This may be necessary in order to validate the approximation model for different wellbore conditions or for different path shapes. As such actions performed in FIG. 3 may repeat until all available wellbore conditions and path shapes are modeled and validated. When determination block 360 identifies that the validation of the approximation model is complete, program flow may move to block 370 where motion of the drill string is controlled based on operation of the approximation model. In certain instances, the approximation model may be validated by allowing automated control of a drilling apparatus, collecting data, and comparing the collected data to well plan data to identify that a wellbore was drilled according to constraints of the well plan data.

The approximation model may identify inputs used to control the drilling apparatus. For example, a processor executing instructions of the approximation model may identify forces used to actuate a steering mechanism of a drill string. In certain instances, an identified actuation force may exceed a force that the steering mechanism can provide. In such an instance, inputs provided to a control interface of the steering mechanism may be identified using an optimization formulation approach that updates values of force determined by operation of the approximation model. As such, when a processor identifies that a force of 5 Newtons (N) should be provided a steering mechanism when the steering mechanism is specified to only apply a maximum 1 N of force (e.g., according to a power requirement of the steering mechanism), the steering mechanism may be controlled to apply the 1 N force. The same may be true for any control input of a drill string. As such, tilt bit angles, an active WOB, stabilizer gaps, or other controls may be controlled based on one or more control inputs. For example, a WOB may be adjusted such that a drill of the drill string may proceed along a path while applying the 1 N force instead of the 5 N force. This may result in extending the life span of a drill of drill string. Because of this, operation of the approximation model and requirements of the drill string may be used to control operation of one or more physical apparatuses of the drill string. Commands may be sent from one or more processors that execute instructions of the approximation model. These commands may include values that were adjusted such that operational requirements of the drill string are not exceeded. These commands may be sent via a control interface when operation of the drill string is controlled autonomously.

Figure 4:
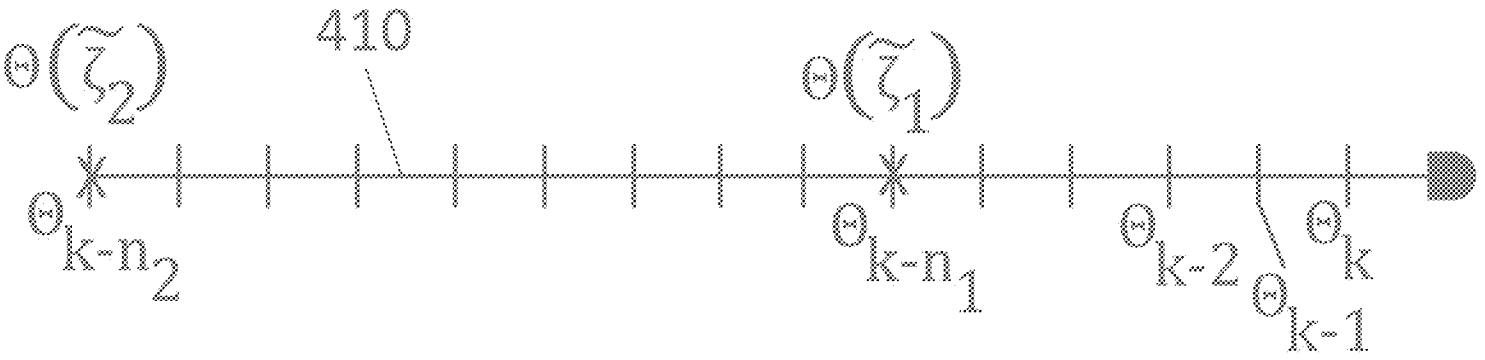
FIG. 4 illustrates a scale that may be used to associate borehole inclination with discrete segments or steps of a borehole, in accordance with various aspects of the subject technology.

FIG. 4 illustrates a scale that may be used to associate borehole inclination with discrete segments or steps of a borehole. FIG. 4 includes graph 410 that includes a series of equally spaced steps along a borehole, where steps $\Theta_{k-n2}$, $\Theta_{k-n1}$, $\Theta_{k-2}$, $\Theta_{k-1}$, and $\Theta_k$ are the borehole inclinations along the BHA. A computer model that models operation of a drilling apparatus using formulas 6-8 below may be referred to as an approximation model. Graph 410 also shows inclinations ($\Theta(\zeta_1)$ and $\Theta(\zeta_2)$ that correspond to steps $\Theta_{k-n2}$ and $\Theta_{k-n1}$ of the borehole as represented by the X marks in graph 410. Here $$T = \frac{\zeta_1}{n_1} = \frac{\zeta_2}{n_2}$$

may refer to the propagation step size of the discretized ODE. By employing the procedure above, the propagation of discretized ODE with uniform step length/size may be formulated for k=1, 2, . . . . N: according to formulae (6):

$$
\begin{cases}
w[k] = \sin(\langle\Theta\rangle_1[k]) = \sin(x_2[k]) \\
\underbrace{\begin{bmatrix} \tilde{q}[k] + \tilde{\gamma}^* \\ -\tilde{q}[k] + \tilde{\gamma}^* \\ -\hat{q}[k] + \psi^* \\ \hat{q}[k] + \psi^* \end{bmatrix}}_{q[k]} = \\
\underbrace{\begin{bmatrix} -\tilde{\lambda}_1 - \sum_{k=1}^{2} \xi_k(\tilde{s}_1) & \tilde{\lambda}_1 + \xi_1(\tilde{s}_1) & \xi_2(\tilde{s}_1) \\ -\tilde{\lambda}_1 + \sum_{k=1}^{2} \xi_k(\tilde{s}_1) & \tilde{\lambda}_1 - \xi_1(\tilde{s}_1) & -\xi_2(\tilde{s}_1) \\ \frac{a_1 + a_2}{\eta\Pi} & -\frac{a_1}{\eta\Pi} & -\frac{a_2}{\eta\Pi} \\ -\frac{a_1 + a_2}{\eta\Pi} & \frac{a_1}{\eta\Pi} & \frac{a_1}{\eta\Pi} \end{bmatrix}}_{Q_{lcp1}} \underbrace{\begin{bmatrix} \theta[k] \\ \langle\Theta\rangle_1[k] \\ \langle\Theta\rangle_2[k] \end{bmatrix}}_{x[k]} + \\
\underbrace{\begin{bmatrix} \xi_{2n}(\tilde{s}_1) & \xi_{2n+1}(\tilde{s}_1) \\ -\xi_{2n}(\tilde{s}_1) & -\xi_{2n+1}(\tilde{s}_1) \\ -\frac{c_1}{\eta\Pi} & -\frac{c_2}{\eta\Pi} \\ \frac{c_1}{\eta\Pi} & \frac{c_2}{\eta\Pi} \end{bmatrix}}_{Q_{lcp2}} \begin{bmatrix} \Gamma[k] \\ w[k] \end{bmatrix} + \underbrace{\begin{bmatrix} \tilde{\gamma}^* \\ \tilde{\gamma}^* \\ \psi^* \\ \psi^* \end{bmatrix}}_{q^*} \\
\{g[k], z[k]\} = LCP_{solve(M_{lcp}, q[k])} \\
\underbrace{\begin{bmatrix} \Theta_k \\ \vdots \\ \theta_{k-n_1} \\ \vdots \\ \theta_{k-n_2} \end{bmatrix}}_{e[k]} = \underbrace{\begin{bmatrix} 0 & \dots & \dots & \dots & 0 \\ 1 & 0 & \dots & \dots & \vdots \\ 0 & 1 & 0 & \dots & \vdots \\ \vdots & \vdots & 1 & 0 & \vdots \\ 0 & \dots & 0 & 1 & 0 \end{bmatrix}}_{\tilde{E}} \underbrace{\begin{bmatrix} \Theta_{k-1} \\ \vdots \\ \theta_{k-n_1} \\ \vdots \\ \theta_{k-n_2-1} \end{bmatrix}}_{e[k-1]} + \underbrace{\begin{bmatrix} \Theta_k \\ 0 \\ \vdots \\ \vdots \\ 0 \end{bmatrix}}_{\tilde{\Theta}[k]} \\
\underbrace{\begin{bmatrix} \Theta_k \\ 0 \\ \vdots \\ \vdots \\ 0 \end{bmatrix}}_{\varpi[k]} = \underbrace{\begin{bmatrix} 0 & 0 & \frac{1}{2} & -\frac{1}{2} \\ 0 & \vdots & 0 & 0 \\ \vdots & \vdots & \vdots & \vdots \\ \vdots & \vdots & \vdots & \vdots \\ 0 & \dots & \dots & 0 \end{bmatrix}}_{M_{T1}} \underbrace{\begin{bmatrix} \gamma_l[k] \\ \gamma_u[k] \\ \psi_l[k] \\ \psi_u[k] \end{bmatrix}}_{g[k]} + \underbrace{\begin{bmatrix} 1 & 0 & 0 \\ 0 & \vdots & 0 \\ \vdots & \vdots & \vdots \\ \vdots & \vdots & \vdots \\ 0 & \dots & 0 \end{bmatrix}}_{M_{T2}} \underbrace{\begin{bmatrix} \theta[k] \\ \langle\Theta\rangle_1[k] \\ \langle\Theta\rangle_2[k] \end{bmatrix}}_{x[k]} \\
x[k+1] = A_d x[k] + B_d u[k]
\end{cases}
\tag{6}
$$

Here $\tilde{\gamma}^*$ and $\psi^*$ may refer to the stabilizer nominal gap and tilt bit saturation angle: respectively; $\gamma_l$ may refer to a stabilizer lower gap; $\gamma_u$ may refer to a stabilizer upper gap; $\psi_l$ may refer to stabilizer bit lower angle; $\psi_u$ may refer to a stabilizer bit upper angle; $LCP_{solve\ (M_{lcp}, q[k])}$ may be used to solve the following equation given a set of constraints:

$$
\underbrace{\begin{bmatrix} \gamma_l[k] \\ \gamma_u[k] \\ \psi_l[k] \\ \psi_u[k] \end{bmatrix}}_{g[k]} = \underbrace{\begin{bmatrix} \xi_{n+1}(\tilde{s}_1) & -\xi_{n+1}(\tilde{s}_1) & 0 & 0 \\ -\xi_{n+1}(\tilde{s}_1) & \xi_{n+1}(\tilde{s}_1) & 0 & 0 \\ -\frac{\beta}{\eta\Pi} & \frac{\beta}{\eta\Pi} & \frac{1}{\eta\Pi} & -\frac{1}{\eta\Pi} \\ \frac{\beta}{\eta\Pi} & -\frac{\beta}{\eta\Pi} & -\frac{1}{\eta\Pi} & \frac{1}{\eta\Pi} \end{bmatrix}}_{M_{lcp}} \underbrace{\begin{bmatrix} F_l[k] \\ F_u[k] \\ F_{g_l}[k] \\ F_{g_u}[k] \end{bmatrix}}_{z[k]} + q[k]
\tag{7}
$$

s.t: $0 \leq g[k] \perp z[k] \geq 0$

Here $\eta$ may be the lateral steering resistance. As mentioned this lateral steering resistance may corresponds to how easily the BHA or a drill bit of the BHA can be rotated or bent. The coefficients in formulas (7) and (9) may be expressed as follows:

$$
\begin{cases}
\xi_k(\tilde{s}_i) = \frac{\tilde{s}_i^2(\tilde{s}_i - 3\tilde{\lambda})}{2\tilde{\lambda}^3}\tilde{\lambda}_k \text{ for } k = 1, 2 \\
\xi_{2n}(\tilde{s}_i) = \frac{\tilde{\Lambda}^2}{4\tilde{\lambda}^3}\left(\tilde{s}_i^2(3\tilde{\lambda} - \tilde{s}_i) - (\tilde{\Lambda} - 3\tilde{\lambda}) + 2\tilde{\lambda}^3(3\tilde{s}_i - \tilde{\Lambda})\right) \\
\xi_{2n+1}(\tilde{s}_i) = \frac{1}{16}\tilde{\omega}\tilde{s}_i^2(-3\tilde{\lambda} + 2\tilde{s}_i)(\tilde{\lambda} - \tilde{s}_i) \\
\xi_{n+1}(\tilde{s}_i) = \frac{\tilde{s}_1^2}{4\tilde{\lambda}^3}\left(\tilde{s}_i^2(3\tilde{\lambda} - \tilde{s}_i)(\tilde{s}_1 - 3\tilde{\lambda}) + 2\tilde{\lambda}^3(3\tilde{s}_i - \tilde{s}_1)\right) \\
a_1 = \frac{\tilde{\lambda}_i}{\tilde{\lambda}^3} \\
\beta = -\frac{2\tilde{\lambda}^3 - 3\tilde{\lambda}\tilde{s}_i^2 + \tilde{s}_i^3}{2\tilde{\lambda}^3} \\
c_1 = -\frac{\tilde{\Lambda}^3 - 3\tilde{\lambda}\tilde{\Lambda}^2 + 2\tilde{\lambda}^3}{2\lambda^3} \\
c_2 = \frac{5}{8}\tilde{\omega}\tilde{\lambda}
\end{cases}
\tag{8}
$$

To validate the approximation model described by equations (6) through (8), outcomes of the approximation model may be compared with those generated by the original DDE model using MATLAB's DDE solver that was configured with both relative and absolute tolerances set at $1\times10^{-8}$. The DDE solver may also be used by other package such as ivp in Python.

Figure 5:
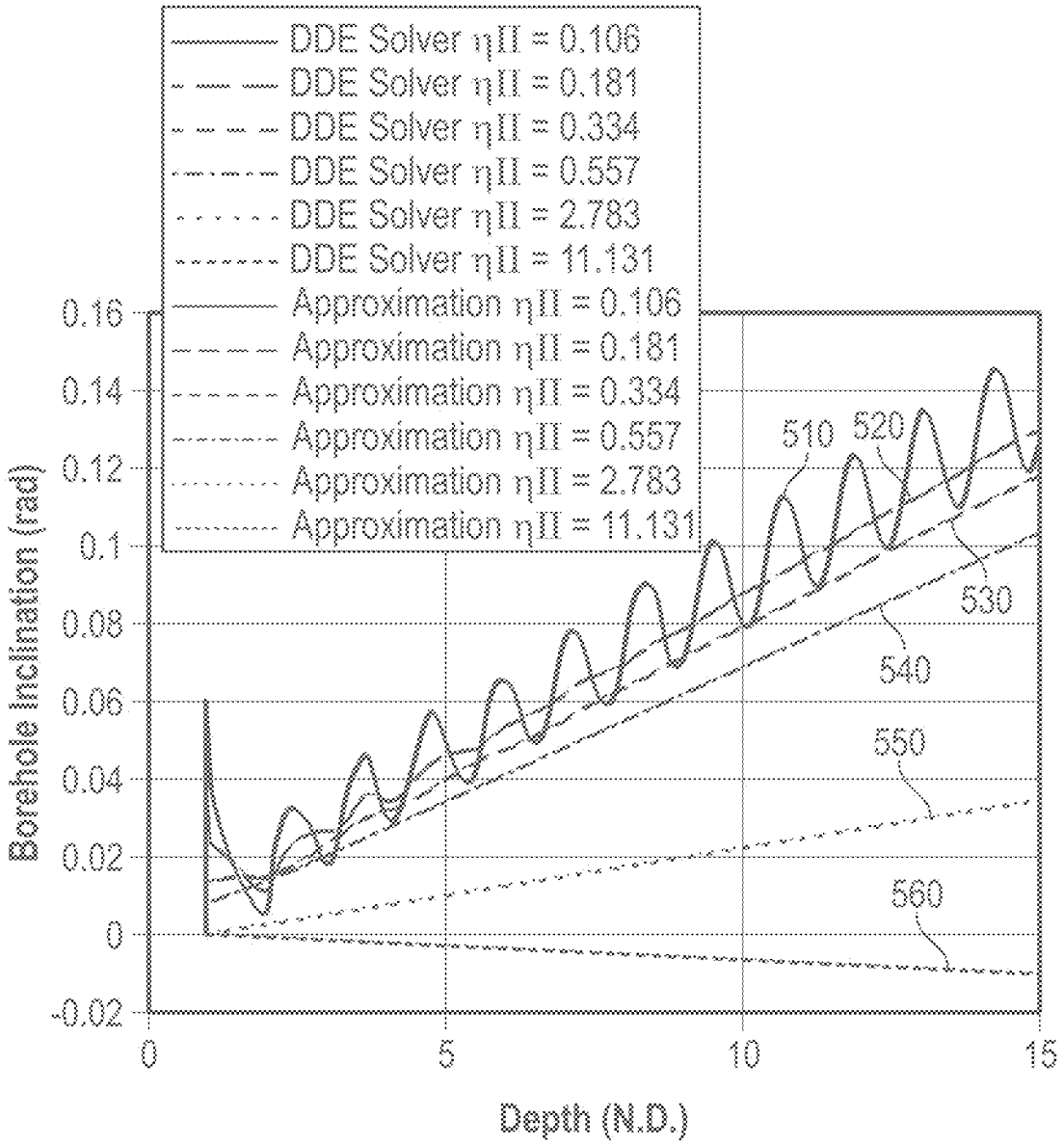
FIG. 5 illustrates a comparison of results of an approximation model with results of a nonlinear delated differential equation model, in accordance with various aspects of the subject technology.

FIG. 5 illustrates a comparison of results of an approximation model with results of a nonlinear DDE model. Congruence of a nonlinear DDE model and an approximation model may be achieved when stabilizer gaps are below a gap threshold angle (or correspond to a range of stabilizer gaps) and when the bit tilt saturation angle is above a bit tilt angle threshold (or correspond to a range of bit tilt saturation angle).

FIG. 5 includes graphs of results of the nonlinear DDE model using solid lines and graphs results of the approximation model using dashed lines. Each of these different graphs are associated with different values of the quantity $\eta\Pi$ (0.106, 0.181, 0.334, 0.557, 2.783, and 11.131). Here $\eta$ refers to lateral steering resistance and $\Pi$ is designates the active weight on bit (WOB). FIG. 5 includes a horizontal axis of borehole depth and a vertical axis of borehole inclination.

For each respective value of the quantity $\eta\Pi$ (0.106, 0.181, 0.334, 0.557, 2.783, and 11.131), the solid lines of the results the nonlinear DDE model and dash lines of the results of the approximation model overlap as shown by overlapping lines 510, 520, 530, 540, 550, and 560. These graphs illustrate that the results of the approximation model correspond to results of the MATLAB DDE solver. Because of this, the approximation model may be classified as being a validated approximation model.

To apply the model within a model predictive control (MPC) framework, it may be essential to transform the control problem into an optimization problem. This transformation may require the discretization of the model, as discussed in respect to formulae 6 through 8 above. It should be noted that at each step, a linear complementarity problem may be addressed. The LCP may typically be resolved using a pivoting method. This may complicate the process of converting the entire model into an integrated optimization problem. In response to this issue, a novel optimization approach that concurrently resolves a linear complementarity problem and determines an optimal input force through mixed integer programming is introduced. The MPC framework for this optimization problem may be expressed as follows:

$$\min_{\Gamma,g,z} J = \sum_{k=1}^{N} \left( \left[ (e[k] - e_{ref}[k])^T, \Gamma[k] \right] Q \left[ (e[k] - e_{ref}[k])^T, \Gamma[k] \right]^T \right)$$

$$\text{s.t.} \begin{cases} w[k] = \sin(x_2[k]) \\ q[k] = Q_{lcp1} x[k] + Q_{lcp2} u_{34}[k] + g^* \\ LCP \begin{cases} g[k] = M_{lcp} z[k] + q[k] \\ z[k] \geq 0 \\ g[k] \geq 0 \end{cases} \\ e[k] = \overline{E}\, e[k-1] + \overline{\Theta}[k] \\ \overline{\Theta}[k] = M_{T1} g[k] + M_{T2} x[k] \\ x[k+1] = A_d x[k] + B_d u[k] \\ |\Gamma[k] - \Gamma[k-1]| \leq \mu \\ |\Gamma[k]| \leq \Gamma_{max} \end{cases} \tag{9}$$

Here Q may be a weighted matrix and is positive definite; μ may be a user chosen parameter to limit the variation in control inputs between two successive commands, facilitating a smooth trajectory; $\Gamma_{max}$ may be the maximum force the BHA can supply. The nonlinear and non-convex optimization problem characterized in (9) may be solved as part of the process of validating the computer models.

Figure 6:
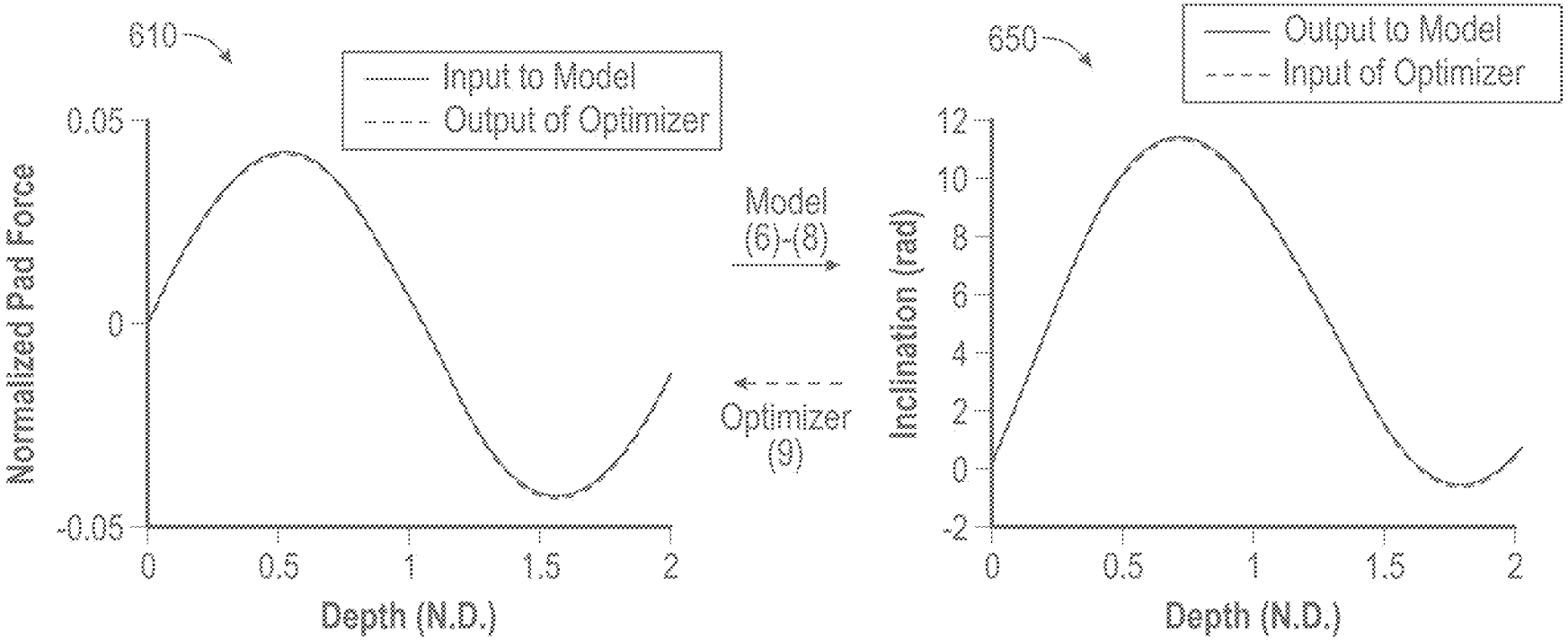
FIG. 6 illustrates two different graphs of a validation of the optimization formulation approach implemented in the approximation model in accordance with various aspects of the subject technology.

FIG. 6 illustrates two different graphs of a validation of the optimization formulation approach implemented in the approximation model discussed above. FIG. 6 includes a first graph 610 that plots borehole depth (horizontal axis of graph 610) versus a normalized pad force (vertical axis of graph 610) and a second graph 650 that plots the borehole depth (horizontal axis of graph 650) with borehole inclination (vertical axis of graph 650).

Validation of the formulation in (9) is shown in the graphs of FIG. 6. A sinusoidal force, depicted in graph 610 is applied to the model as outlined in equations 6 through 8, with the resultant response displayed in graph 650. Graph 610 includes two overlapping curves, a first curve representative of inputs to the approximation model and an output from the optimizer model. Graph 650 also includes two overlapping curves a first curve that plots output of the approximation model and a second curve that plots inputs to the optimizer model.

Subsequently to application of the sinusoidal force and using the response from graph 650 as the reference trajectory for the optimal control described by equation 9, it is demonstrated that the optimizer accurately generates an expected pad force necessary to track the reference trajectory. This outcome verifies the reliability of the proposed optimization formulation.

Figure 7:
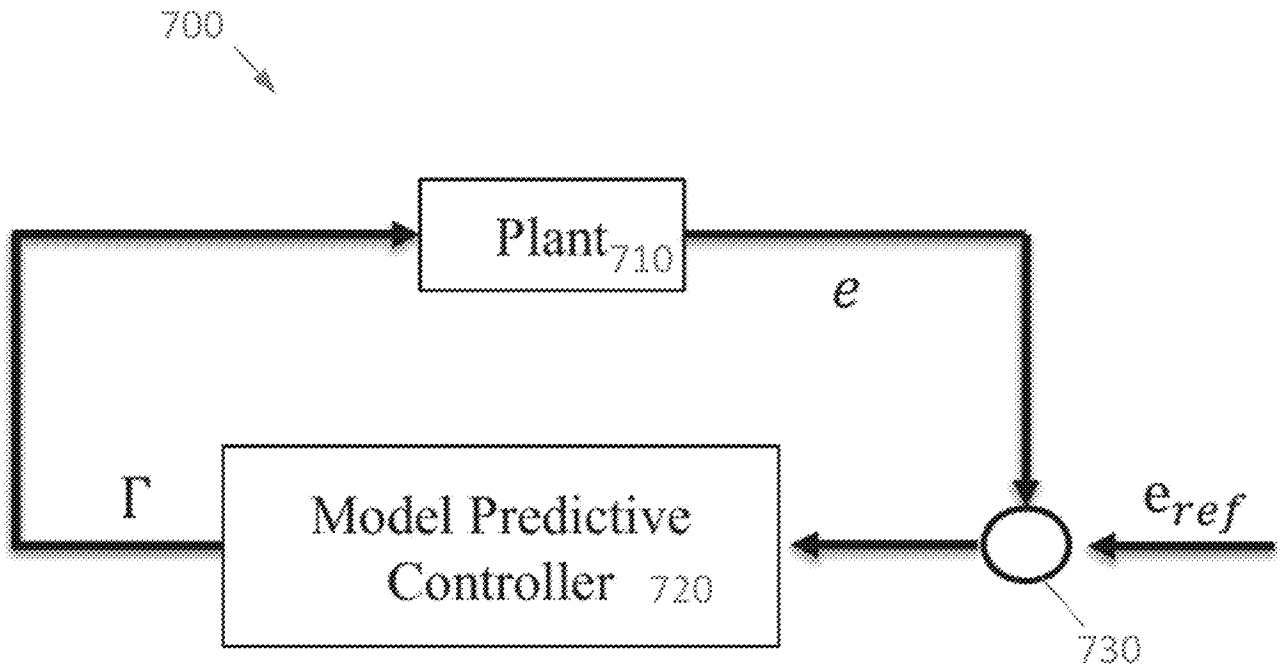
FIG. 7 illustrates components of a control loop that may be simulated by a computer model that does not consider the effects of disturbances or noise on a drilling apparatus, in accordance with various aspects of the subject technology.

FIG. 7 illustrates components of a control loop that may be simulated by a computer model that does not consider the effects of disturbances or noise on a drilling apparatus. The control loop 700 of FIG. 7 includes a plant model 710, a model predictive controller 720, a summing node 730, and control reference input $e_{ref}$. When a borehole is drilled, commands associated with drilling the borehole according to a well plan control reference input $e_{ref}$ may be provided to the control loop. At node 730, input $e_{ref}$ and feedback input e may be provided to the model predictive controller 720 of control loop 700.

Operations performed by the model predictive controller 720 may generate control signals (e.g., values of force Γ) that are provided to plant model 710. Here, plant model 710 may include elements of a BHA (e.g., a drill string 220, rings or stabilizers 240 and drill bit 250 discussed in respect to FIG. 2). In practical application, the optimization problem defined in equation (9) may be solved at discrete points that may be referred to as survey points along a borehole. Locations of specific survey points may be identified from collected data. In certain instances, the location of a survey point may correspond to a step size or measure of distance along the borehole. When a wellbore is drilled, controls used to control a drilling mechanism may be updated at respective survey points along the borehole and drilling between survey points may be associated with one survey point after another. These control inputs may identify a pad force in absolute or relative (e.g., a normalized) pad force and/or an inclination.

In certain instances, among control inputs generated, only those commands that correspond to locations before a next survey may be applied in the plant model 710. Upon conducting a new survey, the problem of controlling the drilling apparatus may be solved again. This may take into account information associated with an updated well plan $e_{ref}$ and new borehole inclinations along the BHA, e. This iterative process is depicted by the control loop of FIG. 7. To ensure the simulation closely mimics reality, the original DDE model—without any simplifications or approximations—may be employed as plant model 710.

Figure 8:
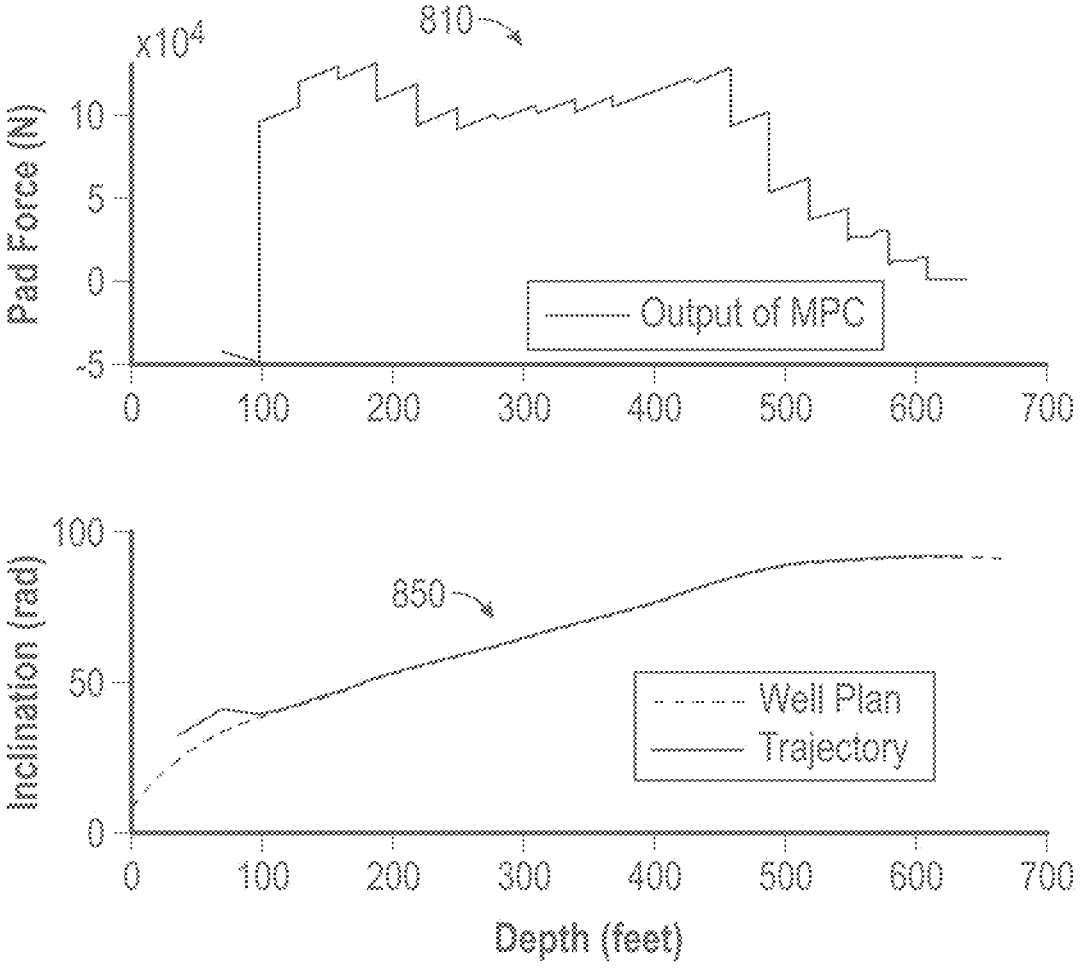
FIG. 8 illustrates results of a simulation that models the components of the control loop of FIG. 7, in accordance with various aspects of the subject technology.

FIG. 8 illustrates results of a simulation that models the components of the control loop of FIG. 7. As such the model used to generate graphs of FIG. 8 may does not model the effects of disturbances and noise. FIG. 8 includes a first graph 810 that shows changes in pad force (the vertical axis of graph 810) versus depth (the horizontal axis of graph 810). For this simulation, a prediction or forecast horizon was established at 30 feet, with surveys conducted every 10 feet. The pad force is adjusted every 0.3 feet, and the well plan was adopted from an existing plan. The second graph 850 of FIG. 8 inclination of the borehole (vertical axis) versus depth (horizontal axis).

To evaluate the controller's performance under challenging conditions, the initial conditions were configured to be ahead of the planned trajectory. The results indicate that initially, the pad force applied by the model predictive controller 720 is negative, effectively steering the BHA back to the intended well path. Subsequently, the BHA adheres to the well plan, following commands from model predictive controller 720 of FIG. 7. Notably, the simulation shows that the BHA reaches its target at approximately 500 feet, where the curvature begins to reduce to zero, indicating the landing phase. Owing to a smoothness constraint in equation (9), the command inputs transition smoothly without abrupt changes. Specifically, the pad force is gradually reduced from $1.2\times10^5$ N to 0 N during landing, demonstrating the controller's effectiveness in managing the BHA's trajectory.

Figure 9:
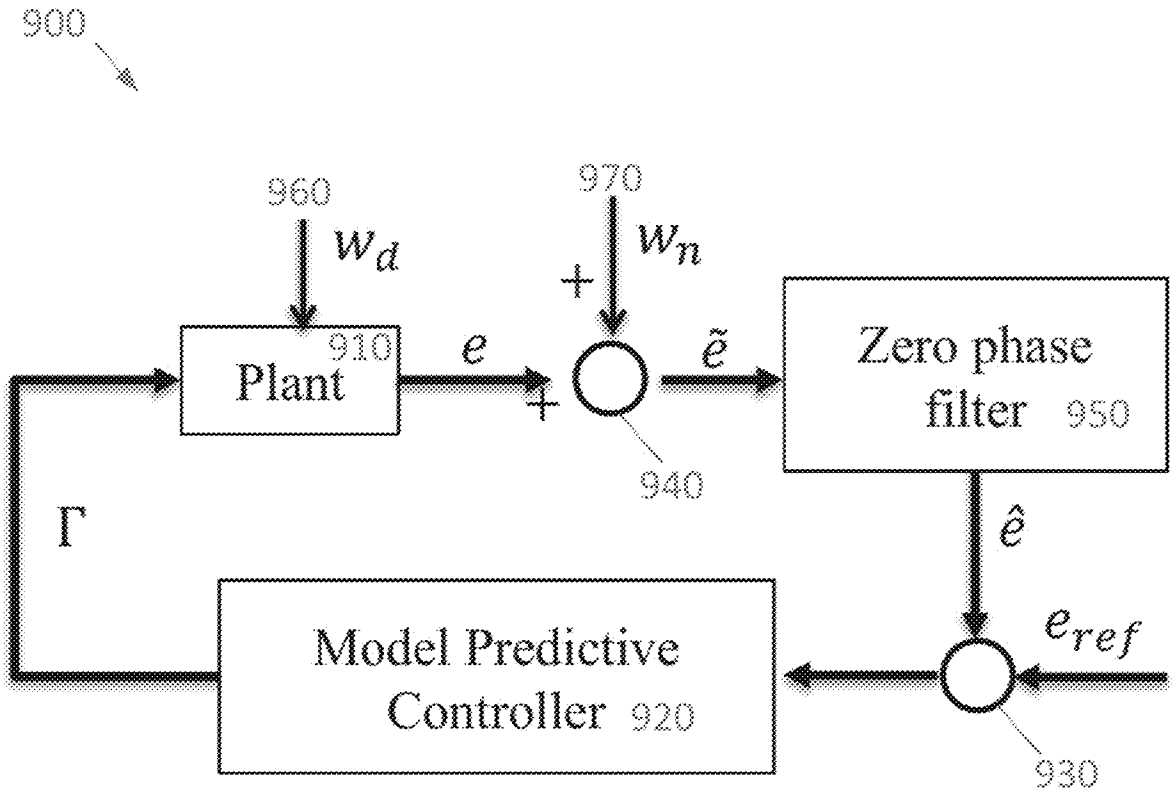
FIG. 9 illustrates components of a control loop that may be simulated by a computer model that does consider the effects of disturbances or noise of a drilling apparatus, in accordance with various aspects of the subject technology.

FIG. 9 illustrates components of a control loop that may be simulated by a computer model that does consider the effects of disturbances or noise of a drilling apparatus. The control loop 900 of FIG. 9 is similar to the control loop of FIG. 7 as both include control reference input $e_{ref}$, model predictive controller 920, and node 930 that perform functions similar to functions discussed in respect to FIGS. 7-8. Unlike FIG. 7, the control loop of FIG. 9 also includes inputs of disturbance ($w_d$) 960 and noise ($w_n$) 970, node 940, and zero-phase filter 950. Feedback e and noise $w_n$ 970 may be combined to generate input $\tilde{e}$ that is provided to filter 950 when filter 950 outputs ê. Filter 950 may be a digital filter that does not introduce phase shift to the signal. This may help preserve the time alignment of a signal's waveform. The frequency response of this zero-phase filter may be set to pass certain frequencies while filtering out or blocking other frequencies. For example, noisy signals with relatively higher frequencies may be filtered out when relatively lower frequency signals characteristic of sound data of interest may be passed on to other processes, stored, or otherwise used or evaluated. Values of ê and $e_{ref}$ may be provided to model predictive controller 920 via node 930.

Because of this, effects of disturbances $w_d$ 960 and noise $w_n$ 970 encountered in real-world drilling operations may be modeled. Functions used to filter out offsets caused by disturbances and/or noise may also be modeled such that operation of filter 950 may be optimized. Such filters may be used to mitigate the effects of modeled disturbances and noise on a real-world drilling apparatus in real-time.

In real-world scenarios, drilling operations face numerous uncertainties that can be classified as disturbances, such as variations in bit side cutting efficiency due to changes in formation, bit wear, alterations in operating parameters, among others. These uncertainties are represented in the model as a disturbance $w_d$ to the plant 910. Specifically, this may be implemented by introducing a Gaussian variation η to the plant, with a standard deviation of 10. This approach is justified by the fact that η significantly influences the ability of a BHA to adjust its inclination, as demonstrated by the simulation results in FIG. 5. On the other hand, sensor measurements are invariably affected by noise. Thus, a Gaussian noise with a standard deviation of 2° is added to the borehole inclination data produced by the plant model. Given that these sensor measurements are used as the new initial conditions for the controller, a phase filter may be employed to denoise and generate an estimated initial condition ê for the controller.

Figure 10:
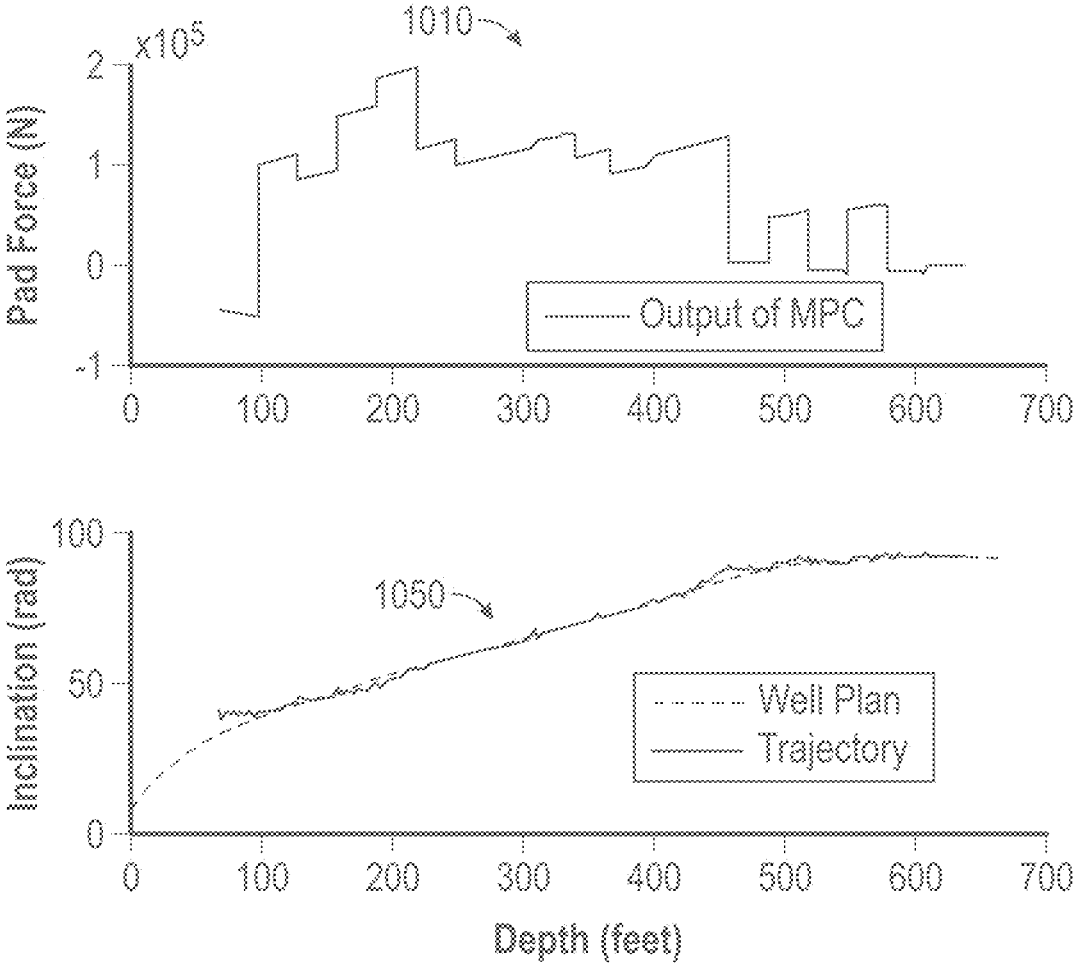
FIG. 10 illustrates results of a simulation that models the components of the control loop of FIG. 9, in accordance with various aspects of the subject technology.

FIG. 10 illustrates results of a simulation that models the components of the control loop of FIG. 9. FIG. 10 includes an upper graph 1010 that shows measures of pad force along a vertical axis versus borehole depth along a horizontal axis. FIG. 10 also includes lower graph 1050 that shows values of inclination along a vertical axis and borehole depth along a horizontal axis.

The simulation outcomes, as depicted in FIG. 10, demonstrate the controller's capability to keep the BHA aligned with the well plan, despite disturbances affecting the plant and measurement noise. The resulting trajectory exhibits a lack of smoothness, attributed to the random fluctuations of η. The controller's strategy, based on a constant η value, is applied to a plant model where η undergoes continuous changes. This discrepancy between the expected and actual conditions may lead to either underestimated or overestimated curvatures, culminating in a non-smooth borehole geometry. This irregular borehole geometry is then fed back to the model predictive controller 920 of FIG. 9 as a non-smooth initial condition, which subsequently influences the commands generated by the model predictive controller 920. Despite the non-smoothness, however, through this feedback mechanism, model predictive controller 920 maintains the BHA on the well plan at least within a threshold tolerance. A comparison with the simulation results shown in FIG. 8 reveals that, although the pad force profile in FIG. 10 lacks smoothness, it remains practical, exhibiting a negative force initially to pull the BHA back to the well plan and a small force during the landing phase.

In the simulations, the propagation step size, T, specified in equation (5), may be set to a normalized length of 0.025, and the number of steps, N, mentioned in equation (9), is selected as 100. When $\lambda_1$=12 feet, a prediction horizon may correspond to the calculation 0.025*12*100=30 feet. The time required to solve equation (9) once is approximately 2 minutes in a MacBook Air laptop with Apple M2 chip and 8G memory, which is considered reasonable given that drilling 30 feet may exceed a time span of 1 hour in real drilling operations. To extend the prediction horizon, one could increase the number of steps, N, which would increase the computational burden. This issue can be addressed by using a more powerful computer or using a different coding platform such as C language.

Figure 11:
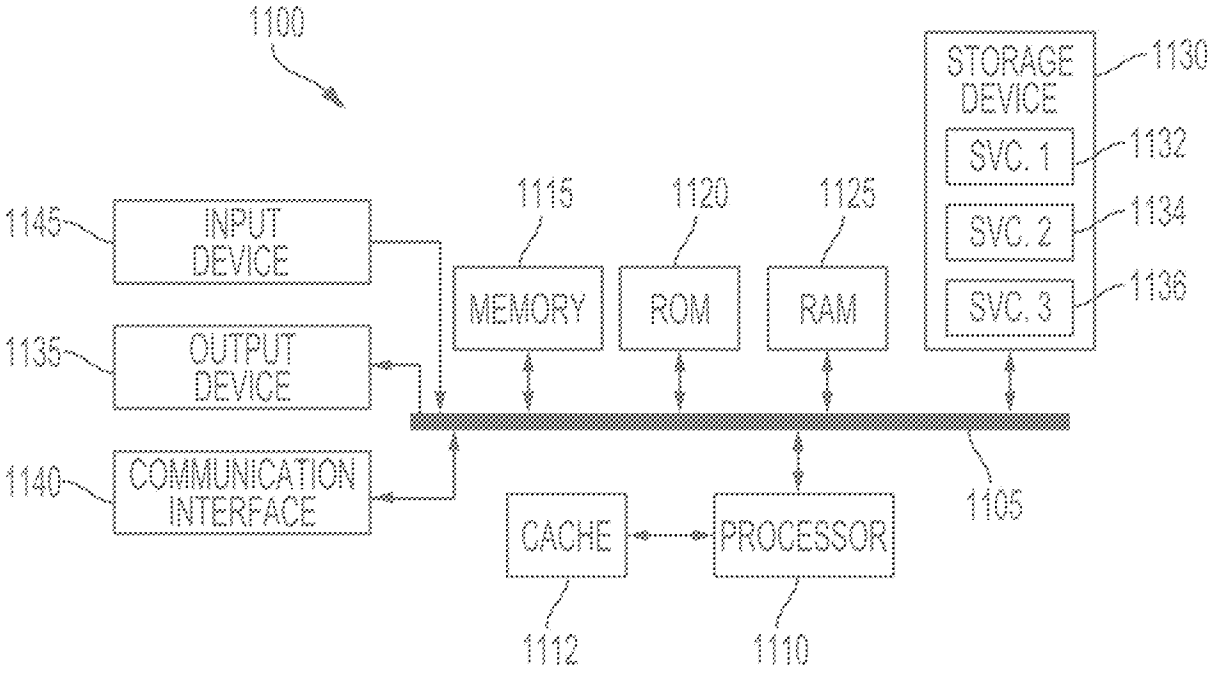
FIG. 11 illustrates an example computing device architecture which can be employed to perform any of the systems and techniques described herein.

FIG. 11 illustrates an example computing device architecture which can be employed to perform any of the systems and techniques described herein. In some examples, the computing device 1100 architecture can be integrated with tools described herein. The components of the computing device architecture 1100 are shown in electrical communication with each other using a connection 1105, such as a bus. The example computing device architecture 1100 includes a processing unit (CPU or processor) 1110 and a computing device connection 1105 that couples various computing device components including the computing device memory 1115, such as read only memory (ROM) 1120 and random access memory (RAM) 1125, to the processor 1110.

The computing device architecture 1100 can include a cache of high-speed memory connected directly with, in close proximity to, or integrated as part of the processor 1110. The computing device architecture 1100 can copy data from the memory 1115 and/or the storage device 1130 to the cache 1112 for quick access by the processor 1110. In this way, the cache can provide a performance boost that avoids processor 1110 delays while waiting for data. These and other modules can control or be configured to control the processor 1110 to perform various actions. Other computing device memory 1115 may be available for use as well. The memory 1115 can include multiple different types of memory with different performance characteristics. The processor 1110 can include any general-purpose processor and a hardware or software service, such as service 1 1132, service 2 1134, and service 3 1136 stored in storage device 1130, configured to control the processor 1110 as well as a special-purpose processor where software instructions are incorporated into the processor design. The processor 1110 may be a self-contained system, containing multiple cores or processors, a bus, memory controller, cache, etc. A multi-core processor may be symmetric or asymmetric.

To enable user interaction with the computing device architecture 1100, an input device 1145 can represent any number of input mechanisms, such as a microphone for speech, a touch-sensitive screen for gesture or graphical input, keyboard, mouse, motion input, speech and so forth. An output device 1135 can also be one or more of a number of output mechanisms known to those of skill in the art, such as a display, projector, television, speaker device, etc. In some instances, multimodal computing devices can enable a user to provide multiple types of input to communicate with the computing device architecture 1100. The communications interface 1140 can generally govern and manage the user input and computing device output. There is no restriction on operating on any particular hardware arrangement and therefore the basic features here may easily be substituted for improved hardware or firmware arrangements as they are developed.

Storage device 1130 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 1125, read only memory (ROM) 1120, and hybrids thereof. The storage device 1130 can include services 1132, 1134, 1136 for controlling the processor 1110. Other hardware or software modules are contemplated. The storage device 1130 can be connected to the computing device connection 1105. In one aspect, a hardware module that performs a particular function can include the software component stored in a computer-readable medium in connection with the necessary hardware components, such as the processor 1110, connection 1105, output device 1135, and so forth, to carry out the function.

For clarity of explanation, in some instances the present technology may be presented as including individual functional blocks including functional blocks comprising devices, device components, steps or routines in a method implemented in software, or combinations of hardware and software.

In some instances, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general-purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples and aspects thereof, but those skilled in the art will recognize that the application is not limited thereto. Thus, while illustrative examples and aspects of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples and aspects of the systems and techniques described herein can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Methods and apparatus of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Such methods may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Statements of the present disclosure include:

Statement 1: A method comprising: accessing data associated with a drill string during a wellbore drilling operation, wherein the data is accessed by one or more processors executing instructions of a computer model; identifying a nonlinear delayed differential equation (DDE) to associate with a portion of a wellbore; converting the nonlinear DDE associated with the portion of the wellbore into a linear time varying DDE; converting the linear time varying DDE into a continuous time varying ordinary differential equation (ODE); and converting the time varying ODE into a discrete ODE, wherein: results of the discrete ODE are identified based on the one or more processors executing the instructions of the computer model, and the results of the discrete ODE are associated with a control input of the drill string. This method may also include adjusting the control input of the drill string based on a limitation of the drill string, wherein motion of the drill string is controlled according to the adjusted control input based on the limitation of the drill string.

Statement 2: The method of statement 1, wherein the motion of the drill string is controlled when at least a portion of the accessed data is collected in real-time.

Statement 3: The method of statement 1 or 2, wherein the linear time varying DDE is identified based on considering terms of the nonlinear DDE as time varying inputs.

Statement 4: The method of any of statements 1 through 3, wherein the continuous time varying ODE is identified based on discrete finite element-based transformations associated with a borehole assembly (BHA).

Statement 5: The method of any of statements 1 through 4, further comprising identifying one or more control inputs the drill string.

Statement 6: The method of statement 5, wherein the one or more control inputs are associated with at least one of stabilizer gaps, or tilt bit angle.

Statement 7: The method of statement 6, wherein a range of the stabilizer gaps corresponds to a distance less than a threshold distance.

Statement 8: The method of statement 6 or 7, wherein a range of the tilt bit angle is greater than a tilt bit angle threshold.

Statement 9: A system comprising: a memory; and one or more processors that execute instructions out of the memory to: access data associated with a drill string during a wellbore drilling operation, identify a nonlinear delayed differential equation (DDE) to associate with a portion of a wellbore, convert the nonlinear DDE associated with the portion of the wellbore into a linear time varying DDE, convert the linear time varying DDE into a continuous time varying ordinary differential equation (ODE), convert the time varying ODE into a discrete ODE, wherein: results of the discrete ODE are identified based on the one or more processors executing the instructions, the results of the discrete ODE are associated with a control input of the drill string, and update the control input of the drill string based on a limitation of the drill string. This system may also include a control interface of the drill string that receives the updated control input of the drill string, wherein motion of the drill string is controlled according to the updated control input based on the limitation of the drill string.

Statement 10: The system of statement 9, wherein the motion of the drill string is controlled when at least a portion of the accessed data is collected in real-time.

Statement 11: The system of statement 9 or 10, wherein the linear time varying DDE is identified based on considering terms of the nonlinear DDE as time varying inputs.

Statement 12: The system of any of statements 9 through 11, wherein the continuous time varying ODE is identified based on discrete finite element-based transformations associated with a borehole assembly (BHA).

Statement 13: The system of any of statements 9 through 12, further comprising identifying one or more control inputs of the drill string.

Statement 14: The system of statement 13, wherein the one or more control inputs are associated with at least one of stabilizer gaps, or tilt bit angle.

Statement 15: The system of statement 14, wherein a range of the stabilizer gaps corresponds to a distance less than a threshold distance.

Statement 16: The system of statements 14 or 15, wherein a range of the tilt bit angle is greater than a tilt bit angle threshold.

Statement 17: A non-transitory computer-readable storage medium having embodied thereon instructions that when executed by one or more processors cause the one or more processors to: access data associated with a drill string during a wellbore drilling operation, wherein the data is accessed by one or more processors executing instructions of a computer model; identify a nonlinear delayed differential equation (DDE) to associate with a portion of a wellbore; convert the nonlinear DDE associated with the portion of the wellbore into a linear time varying DDE; convert the linear time varying DDE into a continuous time varying ordinary differential equation (ODE); and convert the time varying ODE into a discrete ODE, wherein: results of the discrete ODE are identified based on the one or more processors executing the instructions of the computer model, and the results of the discrete ODE are associated with a control input of the drill string. The one or more processors may also execute the instructions to update the control input of the drill string based on a limitation of the drill string, wherein motion of the drill string is controlled according to the updated control input based on the limitation of the drill string.

Statement 18: The non-transitory computer-readable storage medium of statement 17, wherein the motion of the drill string is controlled when at least a portion of the accessed data is collected in real-time.

Statement 19: The non-transitory computer-readable storage medium of statement 17 or 18, wherein the linear time varying DDE is identified based on considering terms of the nonlinear DDE as time varying inputs.

Statement 20: The non-transitory computer-readable storage medium of statements 17 through 19, wherein the continuous time varying ODE is identified based on discrete finite element-based transformations associated with a borehole assembly (BHA).

What is claimed is:

1. A method comprising:

accessing well plan data associated with a drill string during a wellbore drilling operation, wherein the well plan data is accessed by one or more processors executing code that simulates a mathematical model of the drill string as the dill string moves during the drilling operation;

identifying a nonlinear delayed differential equation (DDE) based on one or more parameters associated with a wellbore segment, wherein the nonlinear DDE is a differential equation where a derivative of a function at a certain time is expressed in terms of values of the function at previous times;

converting the nonlinear DDE associated with the portion of the wellbore into a linear time varying DDE;

converting the linear time varying DDE into a continuous time varying ordinary differential equation (ODE) that is a differential equation where a derivative of a function at a certain time is expressed linearly in terms of values of the function at a current time and one or more varying inputs;

converting the time varying ODE into a discrete ODE;

implementing, by the one or more processors, the mathematical model to compute one or more control inputs for the drill string based on the discrete-time ODE; and adjusting the one or more control inputs of the drill string based on one or more constraints of the well plan data to control movement of the drill string.

2. The method of claim 1, wherein the movement of the drill string is controlled when at least a portion of the accessed well plan data is collected in real-time and the one or more constraints of the well plan data comprise:

a steering actuation force limit;

a tilt bit angle limit;

a maximum allowable dogleg severity;

an active weight on bit constraint; or a combination thereof.

3. The method of claim 1, wherein the linear time varying DDE is identified based on considering terms of the nonlinear DDE as time varying inputs.

4. The method of claim 1, wherein the continuous time varying ODE is identified based on discrete finite element-based transformations associated with a borehole assembly (BHA).

5. The method of claim 1, further comprising:

identifying one or more control inputs the drill string.

6. The method of claim 5, wherein the one or more control inputs are associated with at least one of stabilizer gaps, or tilt bit angle.

7. The method of claim 6, wherein a range of the stabilizer gaps corresponds to a distance less than a threshold distance.

8. The method of claim 6, wherein a range of the tilt bit angle is greater than a tilt bit angle threshold.

9. A system comprising:

one or more processors; and at least one computer-readable storage medium having stored therein instructions which, when executed by the one or more processors, cause the one or more processors to:

access well plan data associated with a drill string during a wellbore drilling operation;

access a mathematical model of the drill string that simulates the drill string moving during the drilling operation;

identify a nonlinear delayed differential equation (DDE) based on one or more parameters associated with a wellbore segment, wherein the nonlinear DDE is a differential equation where a derivative of a function at a certain time is expressed in terms of values of the function at previous times;

convert the nonlinear DDE associated with the portion of the wellbore into a linear time varying DDE;

convert the linear time varying DDE into a continuous time varying ordinary differential equation (ODE) that is a differential equation where a derivative of a function at a certain time is expressed linearly in terms of values of the function at a current time and one or more varying inputs;

convert the time varying ODE into a discrete ODE;

implement the mathematical model to compute one or more control inputs for the drill string based on the discrete-time ODE; and adjust the one or more control inputs of the drill string based on one or more constraints of the well plan data to control movement of the drill string.

10. The system of claim 9, wherein the movement of the drill string is controlled when at least a portion of the accessed well plan data is collected in real-time and the one or more constraints of the well plan data comprise:

a steering actuation force limit;

a tilt bit angle limit;

a maximum allowable dogleg severity;

an active weight on bit constraint; or a combination thereof.

11. The system of claim 9, wherein the linear time varying DDE is identified based on considering terms of the nonlinear DDE as time varying inputs.

12. The system of claim 9, wherein the continuous time varying ODE is identified based on discrete finite element-based transformations associated with a borehole assembly (BHA).

13. The system of claim 9, further comprising:

identifying one or more control inputs of the drill string.

14. The system of claim 13, wherein the one or more control inputs are associated with at least one of stabilizer gaps, or tilt bit angle.

15. The system of claim 14, wherein a range of the stabilizer gaps corresponds to a distance less than a threshold distance.

16. The system of claim 14, wherein a range of the tilt bit angle is greater than a tilt bit angle threshold.

17. A non-transitory computer-readable storage medium having embodied thereon instructions that when executed by one or more processors cause the one or more processors to:

access well plan data associated with a drill string during a wellbore drilling operation;

access a mathematical model of the drill string that simulates the drill string moving during the drilling operation;

identify a nonlinear delayed differential equation (DDE) based on one or more parameters associated with a wellbore segment, wherein the nonlinear DDE is a differential equation where a derivative of a function at a certain time is expressed in terms of values of the function at previous times;

convert the nonlinear DDE associated with the portion of the wellbore into a linear time varying DDE;

convert the linear time varying DDE into a continuous time varying ordinary differential equation (ODE) that is a differential equation where a derivative of a function at a certain time is expressed linearly in terms of values of the function at a current time and one or more varying inputs;

convert the time varying ODE into a discrete ODE;

implement the mathematical model to compute one or more control inputs for the drill string based on the discrete-time ODE; and adjust the one or more control inputs of the drill string based on one or more constraints of the well plan data to control movement of the drill string.

18. The non-transitory computer-readable storage medium of claim 17, wherein the motion of the drill string is controlled when at least a portion of the accessed well plan data is collected in real-time and the one or more constraints of the well plan data comprise:

a steering actuation force limit;

a tilt bit angle limit;

a maximum allowable dogleg severity;

an active weight on bit constraint; or a combination thereof.

19. The non-transitory computer-readable storage medium of claim 17, wherein the linear time varying DDE is identified based on considering terms of the nonlinear DDE as time varying inputs.

20. The non-transitory computer-readable storage medium of claim 17, wherein the continuous time varying ODE is identified based on discrete finite element-based transformations associated with a borehole assembly (BHA).

* * * * *